US008894453B2

(12) United States Patent
Case

(10) Patent No.: US 8,894,453 B2
(45) Date of Patent: Nov. 25, 2014

(54) SHALLOW-DRAFT WATERCRAFT PROPULSION AND STEERING APPARATUS

(71) Applicant: Robert Case, East Rochester, NY (US)

(72) Inventor: Robert Case, East Rochester, NY (US)

( * ) Notice: Subject to any disclaimer, the term of this patent is extended or adjusted under 35 U.S.C. 154(b) by 0 days.

(21) Appl. No.: 14/182,902

(22) Filed: Feb. 18, 2014

(65) Prior Publication Data

US 2014/0162507 A1 Jun. 12, 2014

Related U.S. Application Data

(63) Continuation-in-part of application No. PCT/US2013/061830, filed on Sep. 26, 2013.

(60) Provisional application No. 61/705,894, filed on Sep. 26, 2012, provisional application No. 61/793,925, filed on Mar. 15, 2013, provisional application No. 61/882,949, filed on Sep. 26, 2013.

(51) Int. Cl.

| | |
|---|---|
| ***B63H 21/17*** | (2006.01) |
| ***B63B 35/71*** | (2006.01) |
| ***B63H 11/04*** | (2006.01) |
| ***B63H 11/107*** | (2006.01) |
| *B63H 5/125* | (2006.01) |

(52) U.S. Cl.

CPC ..... *B63B 35/71* (2013.01); *B63H 11/04* (2013.01); *B63H 11/107* (2013.01); *B63H 21/17* (2013.01); *B63H 2005/1256* (2013.01)

USPC ..... 440/6

(58) Field of Classification Search

USPC ..... 440/6

IPC ..... B63H 20/04

See application file for complete search history.

(56) References Cited

U.S. PATENT DOCUMENTS

| | | | |
|---|---|---|---|
| 3,587,512 | A | 6/1971 | Patterson |
| 3,685,481 | A | 8/1972 | Mansell |
| 4,406,630 | A | 9/1983 | Wood, Jr. |
| 4,734,066 | A | 3/1988 | Burgess |
| 6,431,923 | B1 | 8/2002 | Knight et al. |

FOREIGN PATENT DOCUMENTS

| | | | |
|---|---|---|---|
| DE | 202008011699 | U1 | 11/2008 |
| EP | 1512623 | A2 | 3/2005 |
| EP | 1876094 | A2 | 1/2008 |
| NL | 1000019 | C1 | 10/1996 |
| WO | WO8903341 | A1 | 4/1989 |
| WO | WO2005108275 | A1 | 11/2005 |
| WO | WO2008134762 | A1 | 11/2008 |

OTHER PUBLICATIONS

ISA/EP, Written Opinion of the ISA and International Search Report of PCT International Application No. PCT/US2013/061830 (Int'l. Filing Date: Sep. 26, 2013, as completed Jan. 17, 2014 and mailed Jan. 24, 2014 (11 pages).

*Primary Examiner* — Stephen Avila

(74) *Attorney, Agent, or Firm* — Hiscock & Barclay, LLP

(57) ABSTRACT

A watercraft includes a stern flotation compartment. The hull is carved out underneath the gunwales to admit a vertical cylindrical sleeve extending through the flotation compartment from top to bottom, and sealed top and bottom. A studded vertical mounting tube carrying an electric motor fits within a slotted cylindrical steering tube; the latter is carried on rotatable bearings affixed to the vertical cylindrical sleeve. A steering assembly is affixed to the slotted cylindrical steering tube and a guide tube fits closely within the vertical mounting tube. An electrical power cable is connected to the electric motor and a retraction assembly is affixed to the electric motor.

3 Claims, 10 Drawing Sheets

SHALLOW-DRAFT WATERCRAFT PROPULSION AND STEERING APPARATUS

CROSS-REFERENCE TO RELATED APPLICATIONS

This application is a continuation-in-part of International Application Serial No. PCT/US2013/061830, filed Sep. 26, 2013, entitled "Shallow-Draft Watercraft Propulsion and Steering Apparatus," which claims priority to U.S. Provisional Applications Ser. Nos. 61/705,894, filed Sep. 26, 2012, entitled "Propulsion and Steering Apparatus for Shallow-Draft Watercraft," and 61/793,925, filed Mar. 15, 2013, entitled "Improved Propulsion and Steering Apparatus for Shallow-Draft Watercraft;" and is a nonprovisional application of, and claims priority to, U.S. Provisional Application Ser. No. 61/882,949, filed Sep. 26, 2013, entitled "Shallow-Draft Watercraft Propulsion and Steering Apparatus," the entirety of each of which is incorporated herein by reference.

TECHNICAL FIELD

This disclosure relates to propulsion and steering systems for watercraft, and more specifically to retractable electric-motor mountings and hull modifications providing for steering of light watercraft such as canoes.

BACKGROUND

Canoes, pirogues, skiffs, dinghies, and similar shallow-draft boats are often used by fishermen or recreational boaters to paddle easily through reaches of shallow water that may be too narrow for rowing or that may be clogged to varying degrees by vegetation and debris. To reduce effort and speed their rate of travel, many boaters attach outboard electric trolling motors to their craft. Electric trolling motors are lightweight, efficient, and virtually silent, and derive their power from batteries or other sources of electric power carried in the boat.

Efficiency of the motor's operation is a critical factor in the utility of such electric motors, since batteries are heavy, and since other sources of electricity such as solar panels are dependent on the intensity of the light they receive. The more efficient the motor, the greater the time the boat may be operated away from its sources of charging. The greater the time between charges, the greater is the range of the boat's possible travel.

Most electric trolling motors are contained in a waterproof cylindrical housing, and drive a propeller at the aft end of the housing. The propeller is used to push the motor and thus the boat through the water. For the electric trolling motor to operate most efficiently, it must be immersed in the water so that its propeller blades are also fully immersed in the water where the flow of water is least disrupted by the boat hull or other parts of the boat that lie directly ahead of the motor and propeller. Although this problem is of less concern with canoe hulls, it is more important in other less-streamlined hull designs. Mounting the motor in the undisrupted water flow confronts a second problem: the presence of debris or vegetation in the path of the boat. Often the motor or propeller can become fouled in plants or lines, or can be damaged by striking hard objects that pass beneath the boat's hull as it moves.

For those boats having a flat stern panel, such as square-stern rowboats or skiffs, the outboard trolling motor is customarily clamped or otherwise mounted to the flat stern piece at the longitudinal centerline or keel line of the boat. For those boats having a pointed stern, such as canoes or pirogues, the outboard trolling motor is customarily clamped or mounted to an external part of a stern crosspiece on one side or the other of the boat. Such mountings place the motor on the side of the pointed stern.

The mounting of a motor on one side of the boat stern introduces a problem with steering. Since the motor is on one side, its thrust along the longitudinal axis of the boat will tend to turn the boat toward the other side. Consequently the tendency to turn the boat must be countered by adjusting the motor orientation, the boat's rudder, or any other steering device used. Such adjustments must vary according to the motor speed and thrust, the wind, and other factors affecting the course of the boat.

From the above observations, there is an evident need for a propulsion system that retains the efficiency, quiet, speed, and other desirable characteristics of the conventional art, while protecting the motor, propeller and mountings from submerged obstacles and debris, and eliminating problems associated with mounting the motor on the side of the boat.

BRIEF DESCRIPTION

One embodiment herein provides a redesigned hull stern, propulsion system, and steering system for a canoe or other light watercraft. The craft's hull contour shows a stern carved out underneath the gunwales to admit a vertical motor shaft mount while streamlining water flow during travel. The vertical motor shaft extends through the craft's stern flotation compartment from above the compartment's top down to an electric motor below the waterline. The vertical motor shaft retracts in shallow water and provides for lateral steering of the motor.

According to various aspects, there is provided a watercraft, comprising:

a) gunwales;

b) a stern flotation compartment;

c) a hull having a modified stern hull contour carved out underneath the gunwales to admit a vertical cylindrical sleeve;

d) the vertical cylindrical sleeve extending through the stern flotation compartment from the compartment's top down to the bottom of the modified stern hull contour and sealed to the compartment's top and sealed to the bottom of the modified stern hull contour;

e) a slotted cylindrical steering tube having one or more vertical slots open through its sides;

f) a steering assembly affixed to the slotted cylindrical steering tube;

g) a vertical mounting tube fitting closely within the slotted cylindrical steering tube;

h) one or more studs anchored to an exterior of the vertical mounting tube, each protruding through one of the one or more vertical slots in the slotted cylindrical steering tube;

i) a guide tube fitting closely within the vertical mounting tube;

j) an electric motor attached to a bottom end of the vertical mounting tube;

k) an electrical power cable connected to the electric motor;

l) a retraction assembly affixed to the electric motor; and m) an upper bearing and a lower bearing both affixed to the vertical cylindrical sleeve and the slotted cylindrical steering tube so as to allow free rotation of the cylindrical steering tube around its longitudinal axis.

According to various aspects, there is provided a watercraft, comprising:

a) a stern flotation compartment;

b) a hull having a modified stern hull contour carved out underneath the gunwales;

c) a vertical cylindrical sleeve extending through the stern flotation compartment from the compartment's top down to the bottom of the modified stern hull contour and sealed to the compartment's top and sealed to the bottom of the modified stern hull contour;

d) a retractable shaft and a steering tube adapted to permit the retractable shaft to rotate, the retractable shaft and the steering tube arranged within the vertical cylindrical sleeve;

e) an electric motor attached to the bottom end of the retractable shaft; and f) an upper bearing and a lower bearing both affixed to the vertical cylindrical sleeve so as to allow free rotation of the cylindrical steering tube around its longitudinal axis.

This brief description is intended only to provide a brief overview of subject matter disclosed herein according to one or more illustrative embodiments, and does not serve as a guide to interpreting the claims or to define or limit the scope of the invention. The claimed subject matter is not limited to implementations that solve any or all disadvantages noted in the background.

DETAILED DESCRIPTION

Figure 1:
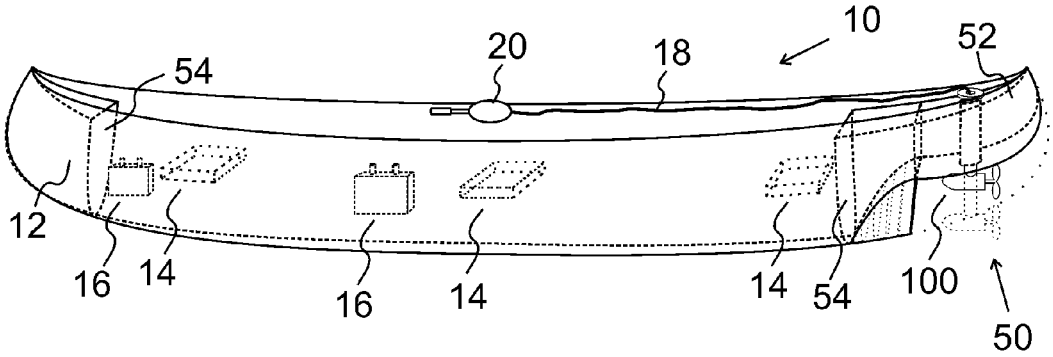
FIG. 1 shows a canoe incorporating hull and motor-related modifications.
Figure 2:
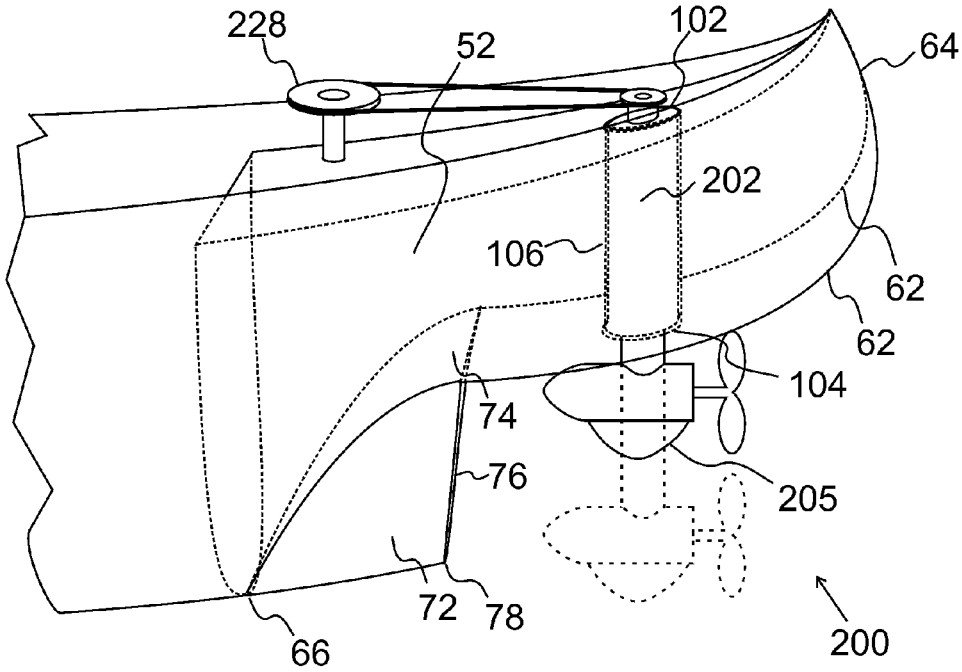
FIG. 2 provides a closer view of a craft's hull and motor-related modifications, showing greater detail.

Referring to FIGS. 1 and 2, a depicted watercraft, e.g., a canoe, has hull 10 pointed at both ends, with a flotation compartment 12, 52 at bow and stern respectively, and two or three flat seats 14 on which a canoeist can face forward. Flotation compartment 12 and flat seats 14 are features of conventional canoes.

FIGS. 1 and 2 show the exemplary craft's hull modifications 50. Each flotation compartment 12, 52 is sealed off from the rest of the canoe by a bulkhead 54, and may be fashioned from flotation foams made from urethane or PVC. Such flotation foam inserts are required for fiberglass hulls to prevent the craft from sinking if the hull is breached. Other options include sealed flotation compartments filled with air, lightweight plastic foam such as foamed polystyrene, air-containing objects such as table-tennis balls, or other substances and structures providing buoyancy. A canoe may or may not have a full-length keel.

In embodiments using conventional electric power, batteries 16 are mounted in the watercraft for connection to cable 18 to supply power to the motor.

The embodiment of craft has a hull modified to accept an electric motor. The craft may be fabricated initially to accept the electric motor or an existing craft may have its hull modified to accept an electric motor. The exemplary craft's hull modifications are most clearly shown in FIG. 2. In a custom-built embodiment, the hull is cut along two contours 62 extending from at or near the topmost stern point 64 in a rough 'S' path as shown, down to where the cuts meet a the keel or centerline 66. The hull's integrity is restored by installing panels 72, 74, and 76, restoring any buoyancy materials, and sealing the seams of panels 72, 74, and 76 to the cut hull.

Panels 72, 74, and 76 are shaped so as to smooth the flow of water past the hull during normal forward travel, narrowing from the conventional hull contour at 66 to a point 78 at the bottom flaring to full hull width at their top. The reshaped keel or centerline at the stern helps straighten and stabilize the course of the watercraft.

Various embodiments described herein may be installed in hulls of watercraft other than canoes, with hull modification appropriate to each hull type.

Two round openings 102 and 104 are drilled one above the other to admit the vertical motor shaft 202 of the craft's propulsion and steering systems, and a sleeve 106 is inserted vertically into the resulting openings and sealed to the hull at both openings 102 and 104 to restore hull integrity again.

In a hull-fabrication embodiment, the craft's hull modifications are subsumed in the design of the hull, after which the hull is vacuum-formed in a single step according to the craft's designed structure. The vacuum-formed hull may or may not incorporate sleeve 106. Buoyancy compartment 52 is formed separately, incorporating opening 102, and sealed to the hull and sleeve 106 as is done in the custom-built embodiment.

In both hull embodiments, the craft's propulsion and steering system 200 is installed and secured in sleeve 106 using any of a range of conventional fittings, longitudinal serrations, adhesives, sealants, and attachment hardware. The installed propulsion and steering system 200 is then connected to motor controls, steering controls, and retraction controls as described hereinbelow.

Figure 3:
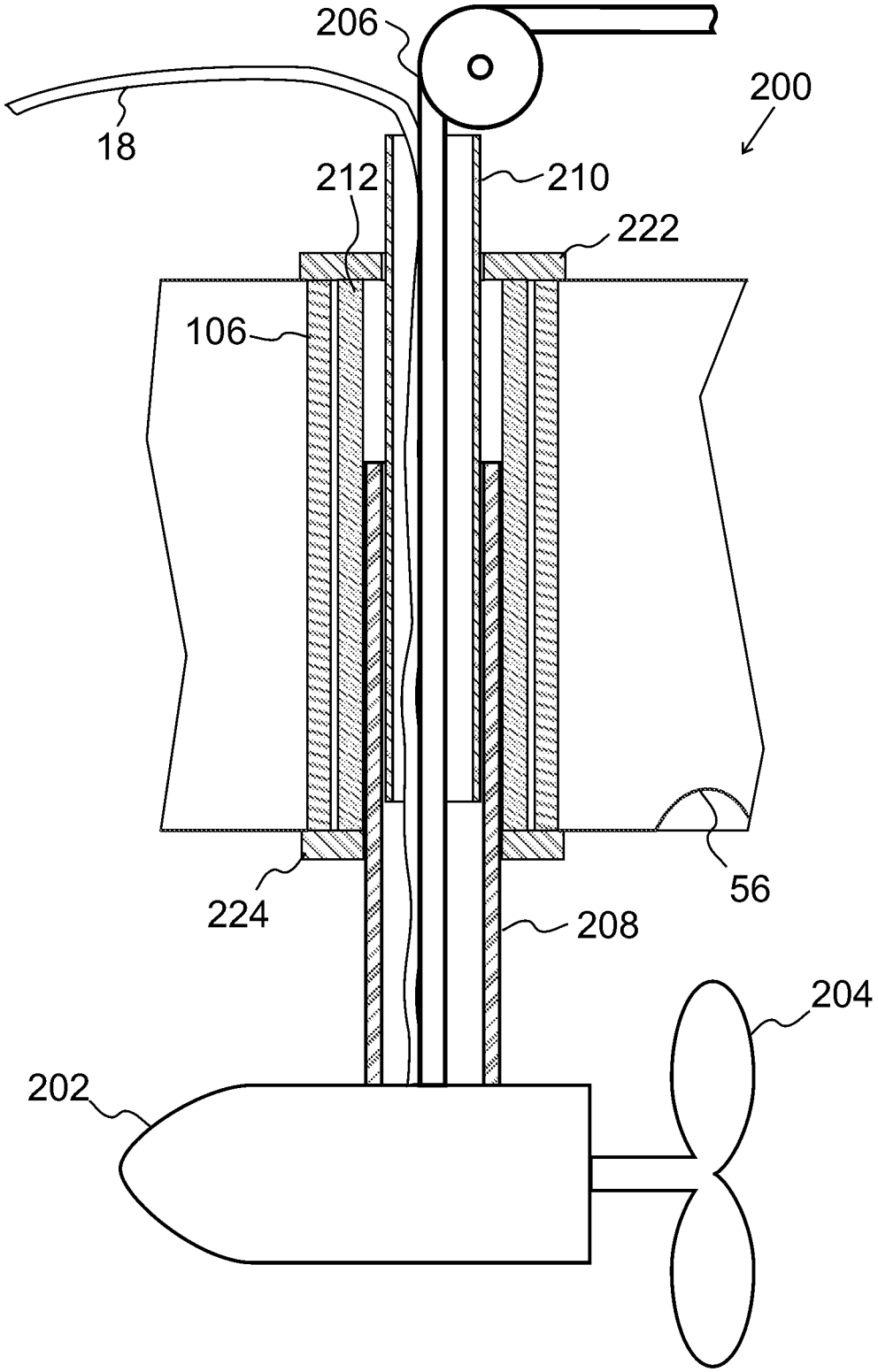
FIG. 3 is a cutaway view of mountings for a motor.
Figure 4:
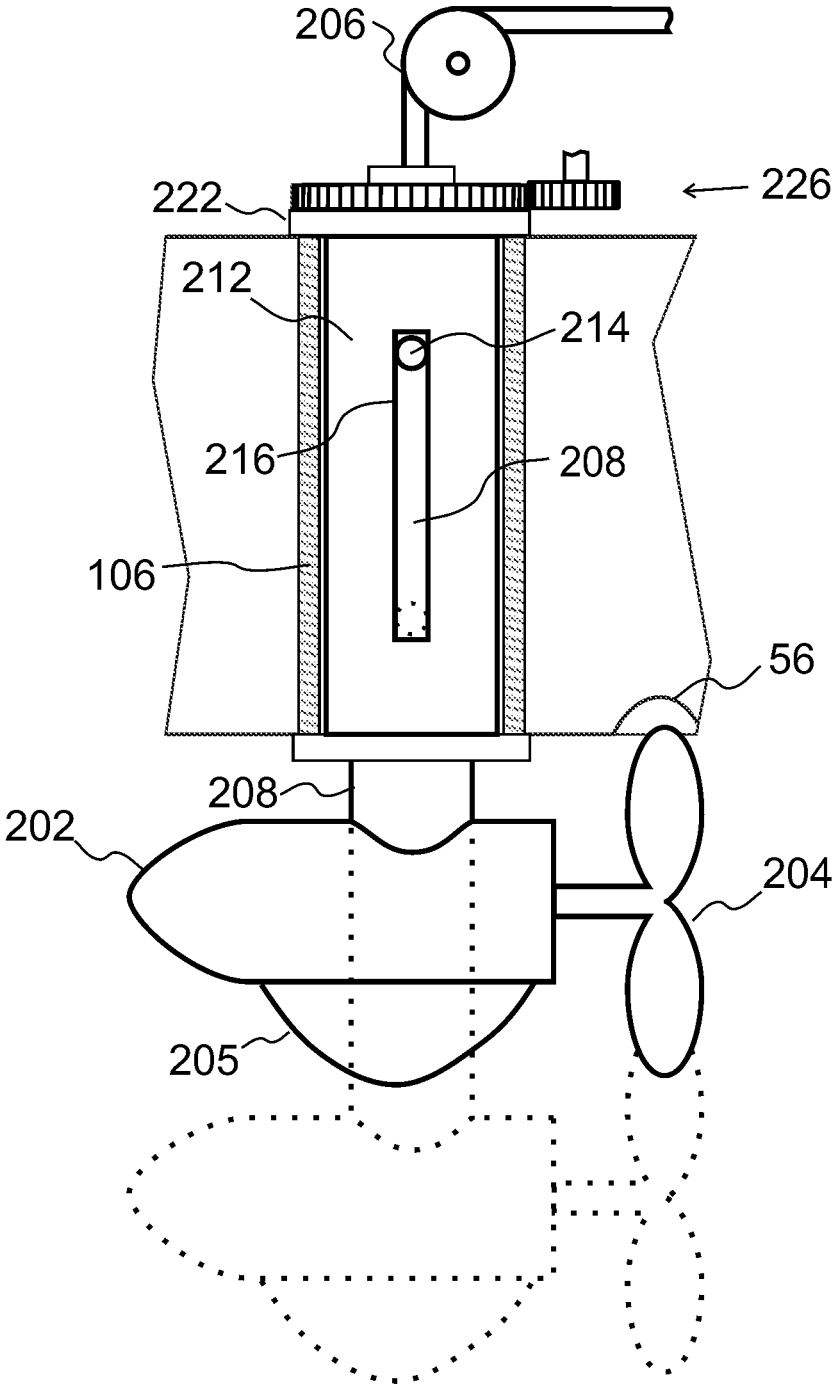
FIG. 4 shows a craft's retraction and steering structures in partial cutaway.

FIGS. 3 and 4 show construction and design of an exemplary craft's propulsion and steering system. As shown in FIG. 3 in a cutaway view, motor 202 with propeller 204 is attached to a vertical retraction arm or cable 206. In a mounting-tube enclosed embodiment, vertical retraction arm or cable 206 and electrical power line 18 are then threaded through vertical mounting tube 208. The result is that the control of power and retraction of motor 202 and propeller 204 may then be accomplished remotely.

Vertical mounting tube 208 is then fitted around guide tube 210, and tubes 208 and 210 are in turn fitted into slotted steering tube 212 as shown in FIG. 4. Vertical mounting tube 208 is then secured to slotted steering tube 212 by a stud 214 that protrudes outward from vertical mounting tube 208 through slot 216 in slotted steering tube 212 as shown in FIG. 4, thereby preventing vertical mounting tube 208 from rotating independently of slotted steering tube 212 while allowing said tube 212 to move vertically throughout the length of slot 216 to retract or extend the motor's position with respect to the watercraft.

Slotted steering tube 212, vertical mounting tube 208, and guide tube 210 comprise vertical motor shaft 202.

The present embodiment separates its steering and retraction functions as follows. Steering is done by turning the propulsion and steering system 200 of motor 202, vertical mounting tube 208, guide tube 210, and slotted steering tube 212, using gears 226 or (as shown in FIG. 2) a pulley 228. Gears 226 or pulley 228 serve to rotate said entire assembly around its vertical axis within sleeve 106. Bearings 222 and 224 provide both stabilization and ease of rotation of said propulsion and steering system 200. More details of bearing 222 and gears 226 are described hereinbelow.

Retraction is done by applying upward retracting force to motor 202 via vertical retraction arm or cable 206. In a retraction-arm embodiment, extension is performed by applying downward pressure at the top of arm 206 or by allowing gravity to lower motor 202. In a retraction-cable embodiment, extension is performed by releasing tension at the top end of cable 206, letting gravity lower motor 202.

Figure 5:
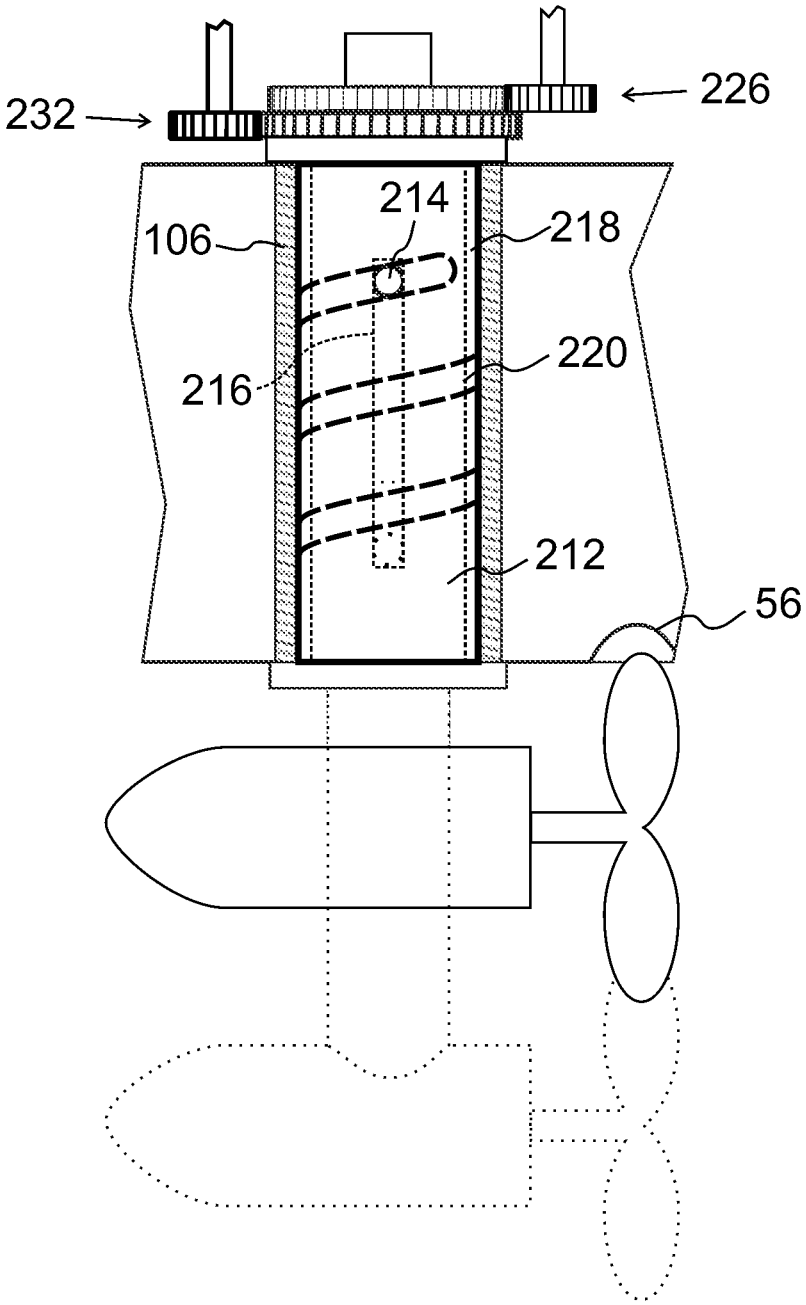
FIG. 5 illustrates a craft's helical retraction-screw embodiment for retraction and extension of the motor, in partial cutaway.

In a retraction-screw embodiment, retraction and extension of motor 202 are performed using an additional rotating sleeve 218 as shown in FIG. 5. Rotating sleeve 218 is fabricated with one or more helical grooves 220 on its inner surface. To incorporate sleeve 218, slotted steering tube 212 in the retraction-screw embodiment is fabricated to provide added space between its outer surface and the inner surface of vertical motor shaft 106, each stud 214 is lengthened so as to protrude into a corresponding helical groove of rotating sleeve 218.

Rotating sleeve 218 is installed concentrically between vertical motor shaft 106 and slotted steering tube 212 so that rotation of sleeve 218 around its vertical axis causes stud 214 to move up or down depending on the direction of rotation. Stud 214 cannot move horizontally due to the restriction imposed by slot 216 of slotted steering tube 212, and therefore the effect is that the entire assembly of motor 202 is retracted or extended as in above-described retraction embodiments.

In said retraction-screw embodiment, retraction and extension are driven by gear system 232, separate from gear system 226 or pulley system 228 used to steer the watercraft.

Figure 6:
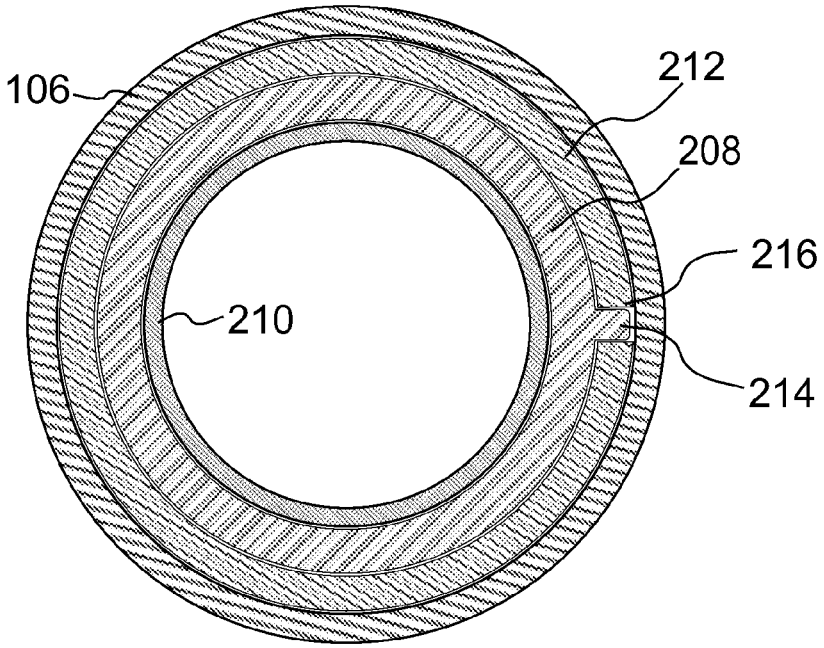
FIG. 6 shows a horizontal cross-section of the vertical tubes, sleeves, and shafts of the propulsion and steering system.
Figure 7:
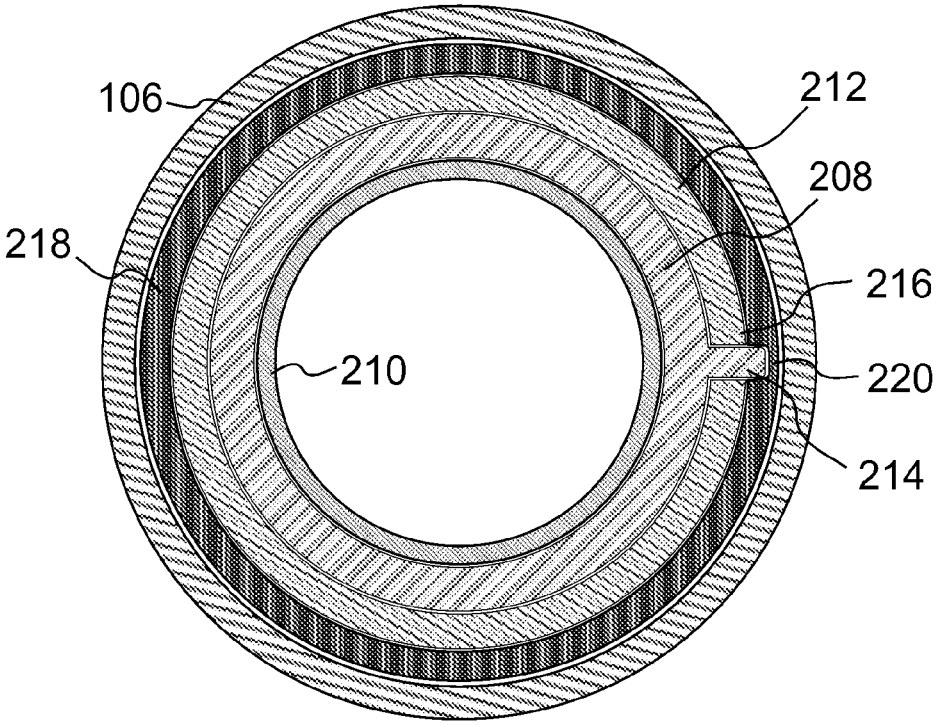
FIG. 7 shows a horizontal cross-section of the vertical tubes, sleeves, and shafts of the propulsion and steering system in a helical retraction-screw embodiment.

For horizontal cross-sections of the vertical tubes, sleeves, and shafts of propulsion and steering system 200 at the level of stud 214, see FIGS. 6 and 7. In order from outermost to innermost for the retraction-cable and retraction-arm embodiments, FIG. 6 shows sleeve 106, slotted steering tube 212,vertical mounting tube 208, and guide tube 210. Stud 214 is also shown protruding from mounting tube 208 into slot 216 in slotted steering tube 212.

Likewise for the retraction-screw embodiment, FIG. 7 shows sleeve 106, rotating sleeve 218, slotted steering tube 212, vertical mounting tube 208, and guide tube 210. Stud 214 is also shown protruding from mounting tube 208 through slot 216 in slotted steering tube 212 into groove 220 in rotating sleeve 218.

Figure 8:
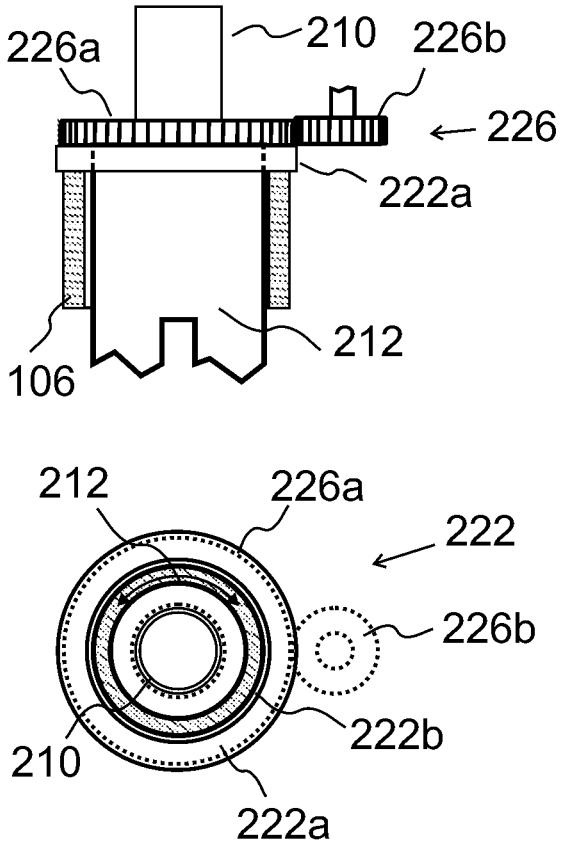
FIG. 8 shows relationships and connections between the sleeve, the upper bearing, the slotted steering tube and steering gears, and the guide tube of the propulsion and steering system, in an exemplary embodiment.

For the relationships and connections between sleeve 106, bearing 222, slotted steering tube 212, gears 226, and guide tube 210, see FIG. 8 showing two views of said components. The fixed portion 222*a* of bearing 222 is anchored to sleeve 106 which is stationary with respect to the boat hull. In a molded hull embodiment, the fixed portion 222*a* of bearing 222 is anchored directly to the hull.

The rotating portion 222*b* of bearing 222 is anchored on its inner surface to the outer surface of slotted steering tube 212.

Direct rotation gear 226*a* of gears 226 is anchored to the top surface of slotted steering tube 212. Driving gear 226*b* of gears 226 meshes with direct rotation gear 226*a*, which provides steering force to propulsion and steering system 200.

The inner opening of gear 226*a* is sized so as to fit snugly to the outer surface of guide tube 210, thereby adding stability to the rotating components of propulsion and steering system 200.

Refer to FIG. 1 to see connection of electrical cable 18 to speed controls 20, and to FIG. 2 to see a pulley connection of slotted steering tube 212 to external pulley 228 for steering.

For embodiments providing improved distribution of steering forces, slotted steering tube 212 has two or more vertical slots 216, each corresponding to a separate stud 214.

For embodiments providing improved range of retraction and extension, vertical mounting tube 208 incorporates telescoping sections, of which the largest at the top serves as vertical mounting tube 208 with stud 214. The sections below telescope inside the largest section.

In FIGS. 3, 4, and 5, recess 56 in the craft's hull allows propeller 204 to be more closely and safely retracted upward.

In FIGS. 2 and 4, fin or vane 205 is attached to the bottom of motor 202 in an embodiment. Vane 205 reduces the probability of damage to propeller 204 in the event of unintentional contact with hard objects or bottom of a body of water. In case of such contacts, vane 205 translates impacts into retraction force to retract the motor and propeller. In order to simplify presentation, vane 205 is not shown in FIGS. 1, 3 and 5.

Fin or vane 205 also contributes to the stabilization of the course of the watercraft, and may be turned when the watercraft is being paddled to offset lateral forces resulting from paddling on one side.

Figure 9:
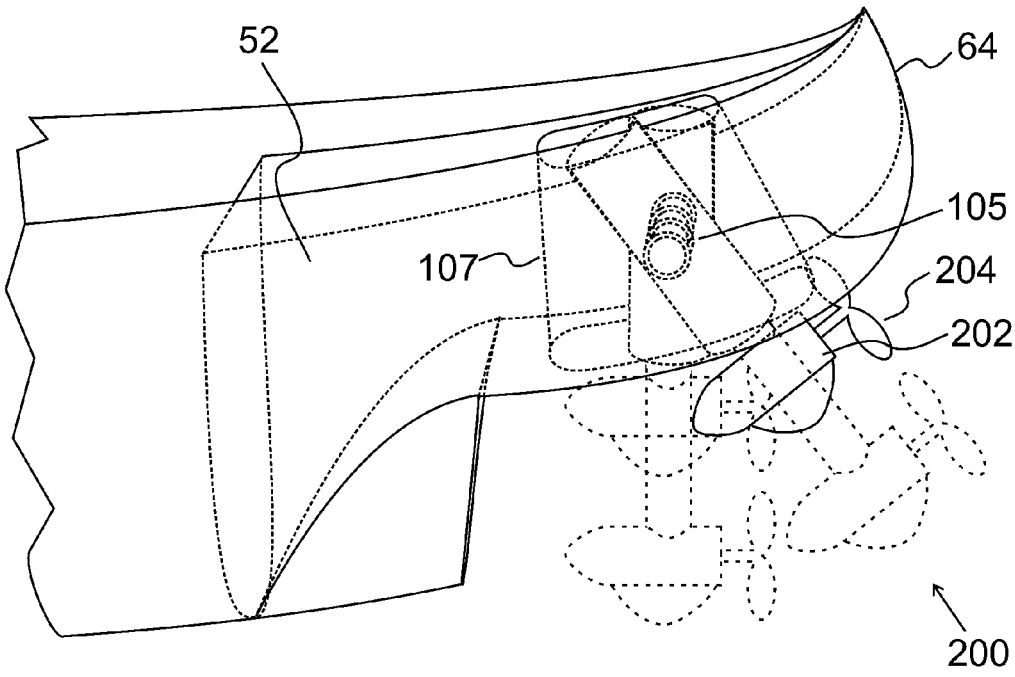
FIG. 9 shows a propulsion and steering system mounted on a lateral pivot.

FIG. 9 shows a propulsion and steering system mounted on a lateral pivot. On watercraft having a geared or integrated steering system mounted atop or around and in a fixed position relative to the propulsion and steering system 200, said steering system and the entire propulsion and steering system 200 described herein can be mounted on a lateral pivot 105 to allow system 200 to rotate in a suitable hull opening 107 either sternward or toward the bow upon encountering obstacles or debris, thereby altering the bodily pitch of motor 202 and propeller 204 as is conventionally provided for outboard motor mounts. Suitable hull opening 107 expands upon and replaces sleeve 106, opening through buoyancy compartment 52 and sealed to the hull at both ends, as shown in FIG. 2.

FIG. 9 shows only sternward rotation, but lengthening of suitable hull opening 107 sternward and providing adequate hull clearance forward of motor 202. The present embodiment provides a low-cost, quiet, lightweight, easy-to-use, long-range propulsion system for users of light watercraft such as canoes, at speeds normally requiring either great manual effort or conventional propulsion systems lacking the craft's advantages.

Figure 10:
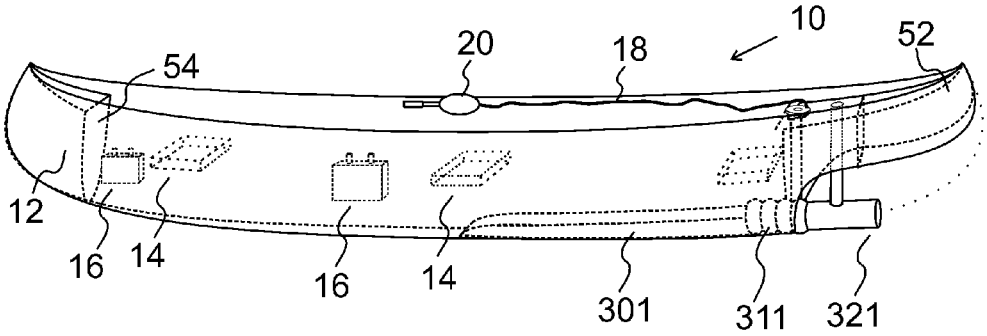
FIGS. 10 and 11 show a flexible-jet jet drive system.

FIG. 10 shows a flexible-jet jet drive embodiment having a jet drive 301, a flexible section 311 for redirecting the output jet, and an output jet 321.

Figure 11:
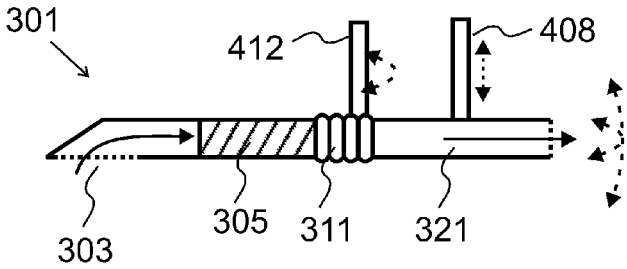

FIG. 11 shows a detailed diagram view of jet drive embodiment 301, with water intake opening 303, electric jet pump drive unit 305, flexible steering and lift passage 311, and movable jet discharge tube 321. FIG. 11 further shows steering shaft and mechanism 412 for lateral redirection of the output jet, and raising and lowering shaft and mechanism 408 for vertical redirection of the output jet.

Figure 12:
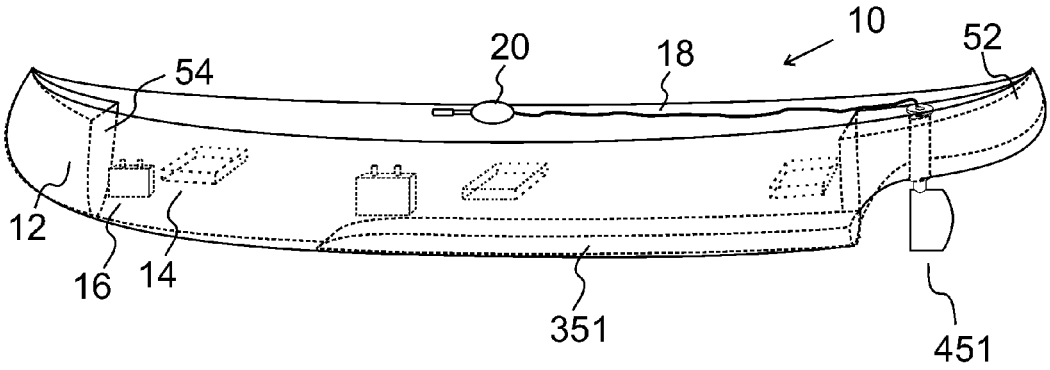
FIG. 12 shows a fixed-jet jet drive system.

FIG. 12 shows a fixed-jet jet drive embodiment having a jet drive 351 (FIG. 13) similar to the jet pump drive unit 305 and flexible section 311 shown in FIG. 10. The flexible section

311 redirects the output jet, and an output jet 321. FIG. 12 further shows rudder 451 for lateral redirection of the output jet.

Figure 13:
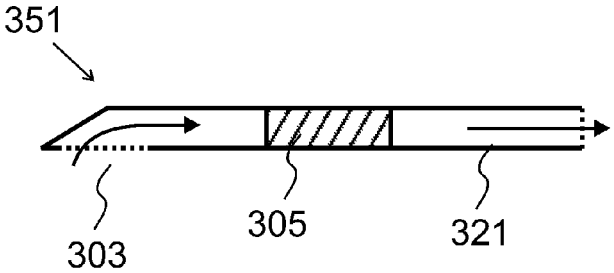
FIG. 13 shows a diagram of a jet drive.

FIG. 13 shows a detailed diagram view of jet drive embodiment 351, with water intake opening 303, electric jet pump drive unit 305, and movable jet discharge tube 321. In an additional feature of embodiment 351, horizontal vanes may be incorporated on rudder 451, and in combination with the tilting feature shown in FIG. 9, may serve to redirect the output jet upward or downward.

Figure 14:
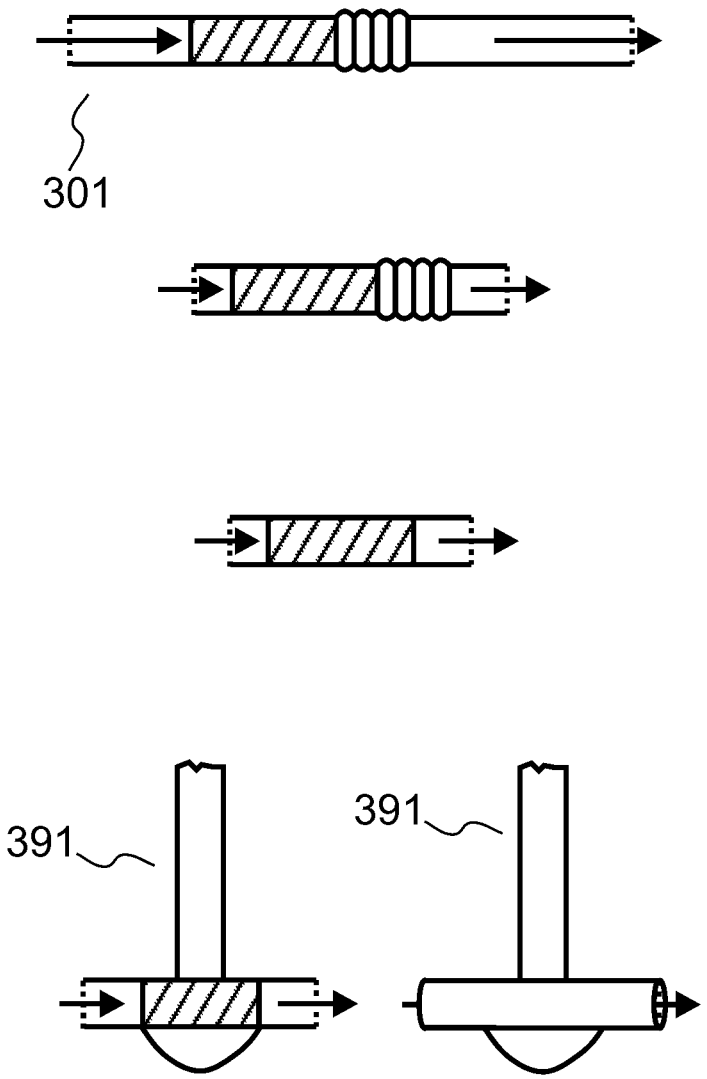
FIG. 14 shows various embodiments of compact jet drives.

FIG. 14 shows a compact jet drive embodiment developed through four stages of design change from jet drive 301 producing a more compact jet drive 391. Compact jet drive 391 may be substituted in all embodiments having electric motor 202 and propeller 204 for said electric motor and propeller, thereby combining the advantages of the jet drive with the steering and raising and lowering features of said embodiments.

What is claimed is:

1. A watercraft, comprising:

a) gunwales;

b) a stern flotation compartment;

c) a hull having a modified stern hull contour carved out underneath the gunwales to admit a vertical cylindrical sleeve;

d) the vertical cylindrical sleeve extending through the stern flotation compartment from the compartment's top down to the bottom of the modified stern hull contour and sealed to the compartment's top and sealed to the bottom of the modified stern hull contour;

e) a slotted cylindrical steering tube having one or more vertical slots open through its sides;

f) a steering assembly affixed to the slotted cylindrical steering tube;

g) a vertical mounting tube fitting closely within the slotted cylindrical steering tube;

h) one or more studs anchored to an exterior of the vertical mounting tube, each protruding through one of the one or more vertical slots in the slotted cylindrical steering tube;

i) a guide tube fitting closely within the vertical mounting tube;

j) an electric motor attached to a bottom end of the vertical mounting tube;

k) an electrical power cable connected to the electric motor;

l) a retraction assembly affixed to the electric motor; and an upper bearing and a lower bearing both affixed to the vertical cylindrical sleeve and the slotted cylindrical steering tube so as to allow free rotation of the cylindrical steering tube around its longitudinal axis further comprising:

m) a rotating sleeve fitting between the slotted steering tube and the vertical motor shaft and having one or more helical grooves on its inner surface each for engaging one of the one or more studs anchored to the exterior of the vertical mounting tube;

n) a retraction gear system engaged with the rotating sleeve for retracting the vertical mounting tube and the attached electric motor.

2. The watercraft of claim 1, wherein the steering assembly comprises a gear train for turning the slotted cylindrical steering tube.

3. The watercraft of claim 1, wherein the steering assembly comprises a pulley system for turning the slotted cylindrical steering tube.

* * * * *